United States Patent [19]

Posey et al.

[11] Patent Number: 4,708,045

[45] Date of Patent: Nov. 24, 1987

[54] REPLACEABLE KNIFE AND HOLDER

[75] Inventors: John L. Posey, McHenry; Josef Schmidt, Libertyville, both of Ill.

[73] Assignee: Baxter Travenol Laboratories, Inc., Deerfield, Ill.

[21] Appl. No.: 818,166

[22] Filed: Jan. 13, 1986

[51] Int. Cl.[4] ..... B26B 5/00; B26D 1/45; B26D 7/10

[52] U.S. Cl. ..... 83/604; 83/698

[58] Field of Search ..... 83/698, 699, 630, 636, 83/639, 604, 597; 30/335, 339; 409/345

[56] References Cited

U.S. PATENT DOCUMENTS

| | | | |
|---|---|---|---|
| 3,530,642 | 9/1970 | Leimert | 53/180 |
| 3,550,275 | 12/1970 | Baun | 30/339 |
| 3,813,998 | 6/1974 | Lotto | 93/33 H |
| 3,894,381 | 7/1975 | Christine et al. | 53/14 |
| 3,945,287 | 3/1976 | Dvorak | 83/698 |
| 4,019,947 | 4/1977 | Stock et al. | 156/510 |
| 4,105,489 | 8/1978 | Lotto | 156/510 |
| 4,106,181 | 8/1978 | Mattchen | 83/698 |
| 4,299,151 | 11/1981 | Burton | 83/300 |
| 4,433,527 | 2/1984 | Ramsey et al. | 53/548 |
| 4,463,542 | 8/1984 | Greenawalt et al. | 53/479 |
| 4,512,138 | 4/1985 | Greenawalt | 53/451 |

*Primary Examiner*—Paul A. Bell
*Assistant Examiner*—Hien H. Phan
*Attorney, Agent, or Firm*—Mary R. Jankousky; Robert M. Barrett; Paul C. Flattery

[57] ABSTRACT

An apparatus for severing a web of film in a form, fill and seal packaging machine. The apparatus includes a removable knife and a holder for removably receiving the knife. The holder includes a channel having a pivot pin and a reduced cross-sectional portion. The knife includes a notch for pivoting on the pivot pin.

12 Claims, 6 Drawing Figures

REPLACEABLE KNIFE AND HOLDER

BACKGROUND OF THE INVENTION

The present invention relates to an apparatus for severing a web of film. More specifically, the present invention relates to a knife and holder for cutting a web of film in a form, fill and seal packaging machine.

Typically, form, fill and seal packaging machines are utilized to package a product in a flexible container. To this end, the form, fill and seal packaging machines are utilized to seal pharmaceuticals, dairy products, wine, foodstuffs, cosmetics, and other products in flexible containers. The form, fill and seal packaging machine provides an apparatus for packaging these products in an expedient manner.

In one type of form, fill and seal packaging machine a web of heat-sealable film is passed over a former or mandrel that forms the film into a tubular shape. To effect a tubular shape, the film is folded longitudinally and heat sealed along abutting longitudinal edges. The tubular shaped film is then passed around a tubular fill system that deposits the product to be packaged into the tubular shaped film. The web of film is then sealed across its width and side seals are created. After the side seals are created the web of film is then severed by a knife or other means between the seals to create individual bags.

In a typical form, fill and seal packaging machine, the knife usually comprises an elongated piece of metal with a ground straight edge. Typically, the knife is unitary with a holder that is mounted at the sealing station of the form, fill and seal packaging machine. To this end, the unitary knife and holder is typically secured between a pair of jaws. Due to the unitary knife and holder construction, the unit typically is expensive. Moreover, because the unit is mounted between a pair of jaws, it is difficult to replace. Typically, the jaws of the machine have to be disassembled to get at the knife and holder assembly. This results in a typical replacement time of approximately one hour.

Usually, in a form, fill and seal packaging machine for making flexible containers, the knife must be changed after approximately every 40–50 manufacturing hours. Due to the expense and burdensome nature of changing the knife and holder unit the prior art knife and holder has presented some disadvantages.

The problems of the prior knife and holders are especially acute in aseptic form, fill and seal machines. In an aseptic form, fill, and seal machine the aseptics of the machine are compromised each time the knife is replaced. Accordingly, each time the knife is changed the aseptics of the machine must be reestablished before production can resume. Thusly, it is expensive, difficult, and burdensome to change the knife and holder, and results in an inordinate amount of downtime for the packaging machine especially in an aseptic packaging machine.

The prior art knife and holder has also suffered from other disadvantages. Due to the straight ground edge of the typical knife it is sometimes difficult to get a straight cut in the web of film. The film has a tendency to fold into the channel in the sealing station of the form, fill and seal packaging machine and accordingly not be subjected to a straight cut by the knife.

Accordingly, there is a need for an improved knife and holder for severing a web of film in a form, fill and seal packaging machine.

SUMMARY OF THE INVENTION

The present invention provides an apparatus for severing a web of film in a form, fill and seal packaging machine. The apparatus includes a removable knife and a holder for removably receiving the knife. The holder includes a channel having a pivot pin and a reduced cross-sectional portion. The knife includes a notch for pivoting on the pivot pin.

Accordingly, it is advantage of the present invention to provide a replaceable quick-change knife, and holder for a form, fill and seal packaging machine.

Furthermore an advantage of the present invention is to provide a relatively inexpensive knife for severing a web of film in a form, fill and seal packaging machine.

Moreover, an advantage of the present invention is to provide a knife for severing a web of film in a form, fill and seal packaging machine that may be changed in an expedient manner.

A further advantage of the present invention is to provide a knife that can be changed in approximately one or two minutes.

Still another advantage of the present invention is to provide a knife that can be removably secured within-a holder that can be permanently mounted in the form, fill and seal packaging machine.

A still further advantage of the present invention is to provide a knife that can be changed without subjecting the form, fill and seal packaging machine to excess downtime.

Additionally, an advantage of the present invention is to provide a knife that can be changed without violating the aseptics of an aseptic form, fill and seal packaging machine.

Furthermore, an advantage of the present invention is to provide a knife for severing a web of film, with an improved cutting edge.

A still further advantage of the present invention is to provide a holder that allows the knife to be easily snap in and out so that the knife can be easily replaced in an expedient manner.

Moreover, an advantage of the present invention is to provide a knife and holder for a form, fill and seal packaging machine that allows the user to store a plurality of knives in the aseptic environment of the packaging machine and allows one to replace the knives in an aseptic manner.

Additional features and advantages are described in, and will be apparent from, the detailed description of the presently preferred embodiments, and from the drawings.

DETAILED DESCRIPTION OF PRESENTLY PREFERRED EMBODIMENTS OF THE INVENTION

Figure 1:
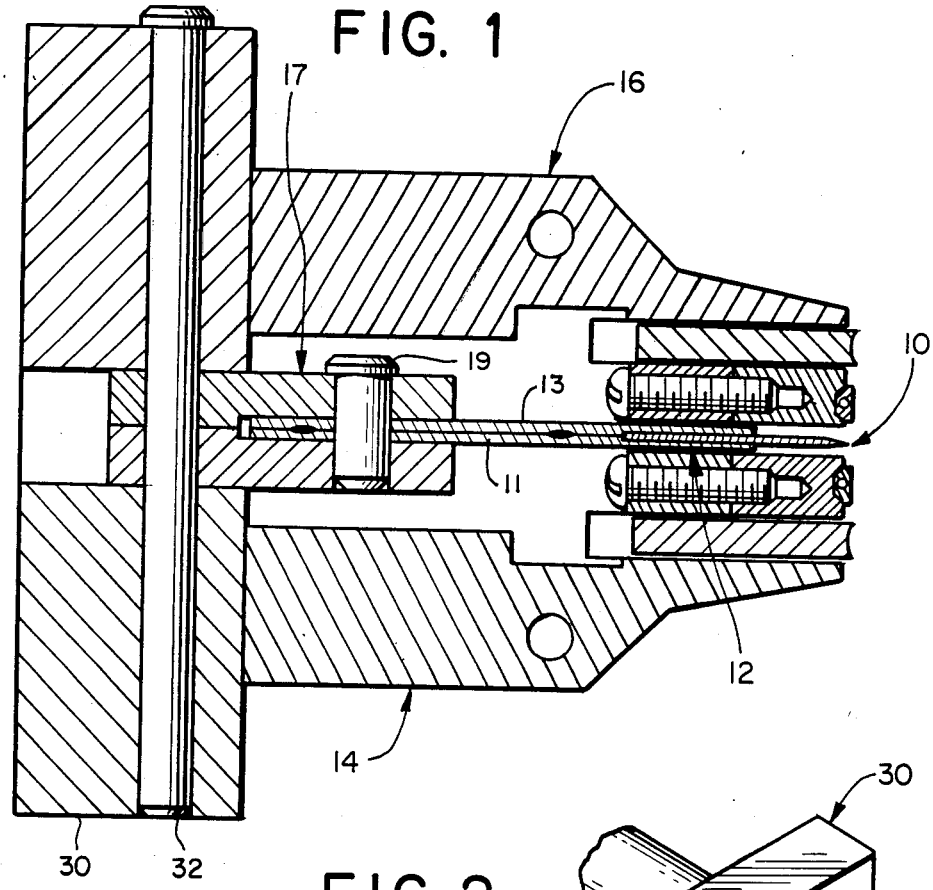
FIG. 1 illustrates a cross-sectional view of the knife and holder of the present invention located between a pair of jaws.

Referring to FIG. 1, the knife 10 and holder 12 of the present invention are illustrated. As illustrated, typically, the holder 12 is located between a set of jaws 14 and 16 in the sealing station of a form, fill and seal packaging machine. As used herein, the term "form, fill and seal packaging machine" means a packaging machine for creating from a web of film a bag filled with a product. As used herein, the term "sealing station" means the station at which the web of film is sealed to itself, by heat or other means, to create seals in the web of film.

Figure 2:
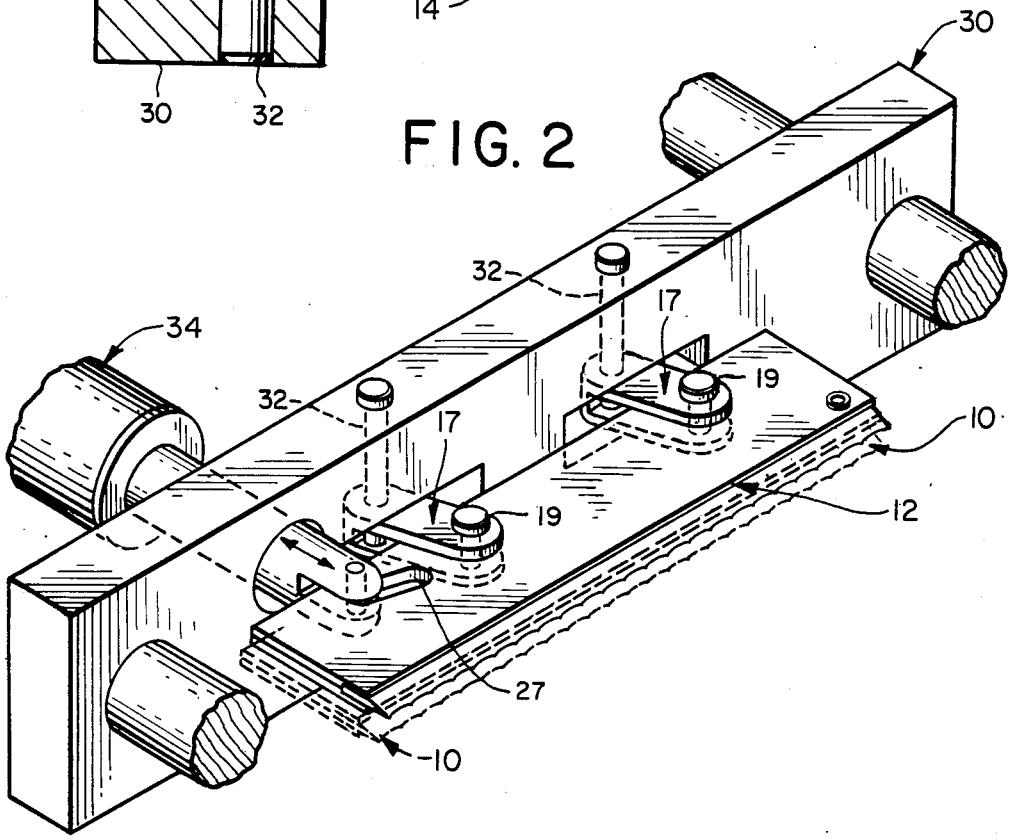
FIG. 2 illustrates a perspective view of the knife and holder of FIG. 1 without the jaws.

Referring to FIGS. 1 and 2, the holder 12 is secured at the sealing station between the jaws 14 and 16 by a lever arm 17. The lever arm 17 positions the knife 10 between the jaws 14 and 16 and directs the motion of the knife. The holder 12 is secured to the lever arm 17 by a pin 19.

The lever arms 17 are secured to a jaw meeting bar 30 by pins 32. The jaws 14 and 16 are also secured to the jaw meeting bar 30. The pins 32 not only secure the lever arms 17 to the jaw meeting bar but also function as pivot pins for the lever arms.

As further indicated in FIG. 2, an air cylinder 34 is secured to the holder 12. The air cylinder 34 accuates the knife 10 and holder 12.

Figure 3:
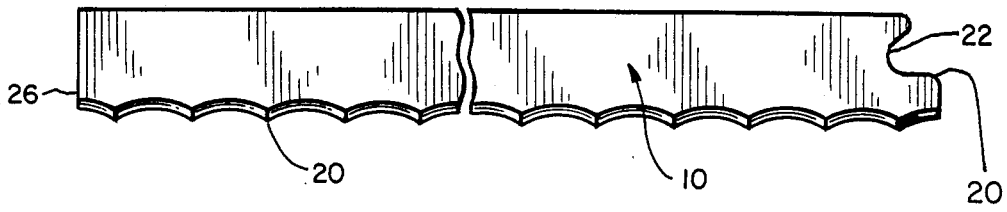
FIG. 3 illustrates a top elevational view of the knife of the present invention.

Referring now to FIG. 3, the knife 10 is illustrated. The knife 10 functions to sever the web of film between side seals to create individual bags. To this end, the knife 10 includes on one side a set of serrations or teeth 20. Because of the teeth 20 the knife 10 can cut the web of film in a sweeping motion rather than a plunging motion. As illustrated in FIG. 2 in phantom lines, due to the construction of holder 12, the knife cuts the film in a sweeping motion. This provides a straight cut that does not suffer the disadvantages previously described, i.e., that the film can deformed into the channel located diametric to the knife in the sealing station of the packaging machine.

The knife 10 includes at one end 20 a notch 22. The notch 22 is designed to allow the knife 10 to be pivoted against a pin 24 in the holder 12. To this end, the notch 22 is designed so that it receives a portion of the pin 24. Accordingly, as discussed in detail below, the knife 10 is easily secured within the holder 12.

Figure 4:
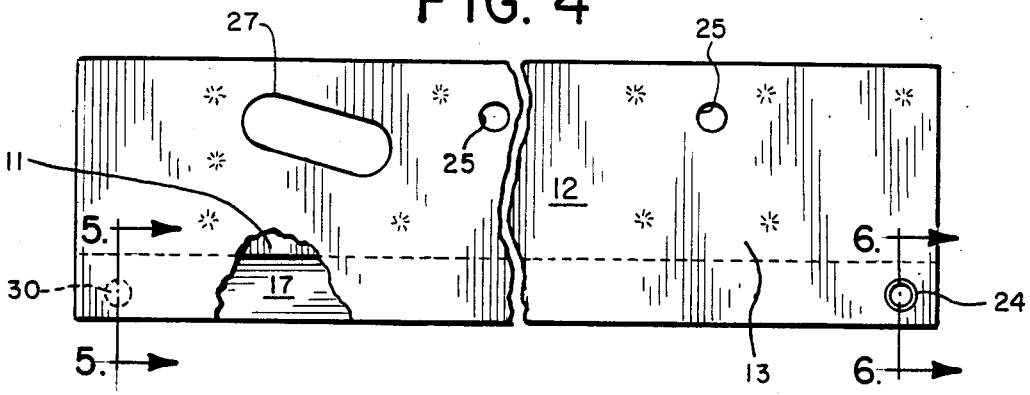
FIG. 4 illustrates a top-elevational view of the holder of the present invention.
Figure 5:
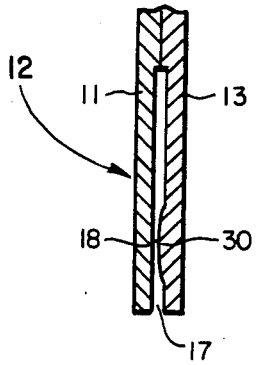
FIG. 5 illustrates a cross-sectional view of the holder of FIG. 4 taken along lines 5—5.
Figure 6:
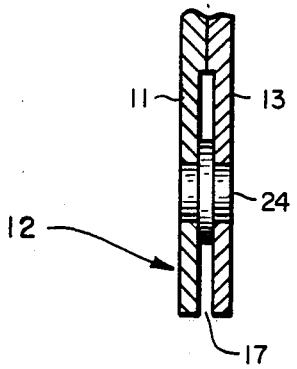
FIG. 6 illusrates a cross-sectional view of the holder of FIG. 4 taken along lines 6—6.

FIGS. 4, 5 and 6 illustrate the holder 12 of the present invention. As discussed above, the holder 12 is designed to be secured between a pair of jaws 14 and 16 at the sealing station. The holder 12 functions to removably secure the knife 10. To this end, the holder 12 comprises two halves 11 and 13. The two halves 11 and 13 are secured together by rivet or other means. Of course, the holder 12 can comprise a single unitary unit, or the halves 11 and 13 can be secured together by other means.

Referring now to FIG. 6, the holder 12 includes a channel 17. The channel 17 is constructed so that it removably receives the knife 10. Accordingly, the channel 17 has a cross-sectional width that is greater than the cross-sectional width of the knife 10. Located at one end of the channel 17 is the pin 24. As set forth above, the pin 24 provides a means for pivoting the knife 10 into the channel 17. To this end, the pin 24 comprises a metal rod that extends across the cross-sectional width of the channel 17.

Referring now to FIG. 5, located at a second end of the channel 17 of the holder 12 is a projection 30. The projection 30 functions to reduce a portion 18 of the cross-sectional width of the channel 17. The reduced cross-sectional width functions to secure the knife 10 within the channel 17.

To position the knife 10 in the holder 12, the first end 20 of the knife 10 is pushed into the first end of the channel 17 so that the pivot pin 24 is received within the notch 22. The second end 26 of the knife 10 is then pivoted towards the second end of the channel 17. The knife 10 is pushed into the channel 17 where the knife 10 is securely received by the portion 18 of the channel 17 with a reduced cross-sectional width.

Because the knife 10 cuts the web of film in a sweeping motion the knife may be secured within the holder 12 by just the pivot pin 24 and the reduced cross-sectional portion 18 of the channel 17. The sweeping motion forces the knife 10, and specifically the notch 22, back against the pivot pin 24 and within the holder 12. If desired however, a hole (not shown) may be located at the second end 26 of the knife 10 and a screw or other securing device may be located in the holder 12 to secure the knife 10 within the holder 12.

The knife 10 is preferably constructed from a metal such as stainless steel. The knife 10 can be inexpensively created from commercially available long band knife blades with teeth. The long band knife blade can be cut to size with the necessary notch cut therein. It has been found that a long band knife blade available from Simmons Engineering of Mount Prospect, Ill. that is three-quarters of an inch wide and 20/1000 inch thick and constructed from SDB stainless steel functions satisfactorily.

The holder 12 is preferably constructed from a metal such as stainless steel. It has been found that a holder 12 constructed from Type 304 stainless steel functions satisfactorily.

In order to replace the knife 10, one merely grips the second end 26 of the knife with a pair of pliers or other gripping means and pulls downwardly removing the knife from the reduced cross-sectional portion 18 of the channel 17. The knife 10 is then pivoted on the pivot pin and can be removed from the channel 17 of the holder 12. A new knife can then replace the used knife by reversing the procedure. As can be seen, because the knife 10 is easily removed from the holder 12 a quickly replaceable knife is provided.

In an aseptic type form, fill and seal packaging machine a plurality of knives 10 may be stored at the sealing station within the packaging machine. The knives 10 and holder 12 can then be accessible by a glove(s) that would allow one access to the machine without compromising the aseptics of the machine. Of course, other means for accessing the machine can be used. Accordingly, when the knife 10 must be replaced in the holder 12 one merely would replace the knife as set forth above utilizing the available glove(s) or other accessing means. Accordingly, the aseptic environment of the form, fill and seal machine would not be compromised and the aseptics of the packaging machine would not have to be reestablished after every knife change.

It should be understood that various changes and modifications to the preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

We claim:

1. An apparatus for severing a web of film comprising:

a holder mountable to a reciprocating jaw including means for securing the holder to the reciprocating jaw and a channel having at a first end a pivot pin and at a second end a reduced cross-sectional width;

an elongated knife removably received within the channel and having a cutting surface that extends from a bottom of the holder when the knife is received within the channel including means for pivoting on the pivot pin; and the means securing the holder to the piston means including a pivoting member for imparting a sweeping motion to the holder and knife as the piston means exerts a force against the holder.

2. The apparatus of claim 1 wherein the cutting surface includes teeth.

3. The apparatus of claim 1 wherein the means for pivoting on the pivot pin includes a notch at an end of the knife.

4. The apparatus of claim 1 wherein the knife and holder are constructed from stainless steel.

5. The apparatus of claim 1 wherein in the holder includes two halves that are secured together.

6. An apparatus for severing a web of film in a form, fill and seal packaging machine comprising:

at least one pair of jaws, at least one lever arm coupled to the jaw;

a holder secured to the lever arm and located between the pair of jaws including a top, two sides, and a bottom, and having two side walls defining a channel having at a first end a pivot pin extending from a first of the side walls to a second of the side walls across the channel and at a second end means for reducing a portion of the cross-sectional width of the channel extending from one of the side walls;

a knife removably secured within the channel the knife including means for pivoting on the pivot pin and including a cutting surface, the cutting surface extending from the bottom of the holder when the knife is secured within the holder; and the holder being coupled to means for imparting a sweeping motion to the holder and knife.

7. The apparatus of claim 6 wherein:

the means for reducing a portion of the cross-sectional width includes a projection; and the means for pivoting includes a notch.

8. The apparatus of claim 6 wherein the cutting surface of the knife extends across the bottom of the holder from one side of the holder to the other side.

9. The apparatus of claim 6 wherein the holder is secured to the lever arm by a pivot pin.

10. The apparatus of claim 6 wherein:

the pair of jaws are secured to a jaw meeting bar; and two lever arms are secured to the meeting bar and to the holder.

11. The apparatus of claim I0 wherein the lever arms are secured to the holder by pivot pins.

12. The apparatus of claim 6 wherein the means for imparting a sweeping motion includes an air piston pivotally coupled to the holder.

* * * * *

UNITED STATES PATENT AND TRADEMARK OFFICE

CERTIFICATE OF CORRECTION

PATENT NO. : 4,708,045

DATED : November 24, 1987

INVENTOR(S) : John L. Posey and Josef Schmidt

It is certified that error appears in the above-identified patent and that said Letters Patent is hereby corrected as shown below:

Column 5, line 29, delete "in".

Signed and Sealed this

Fifth Day of December, 1989

*Attest:*

JEFFREY M. SAMUELS

*Attesting Officer*

*Acting Commissioner of Patents and Trademarks*